US006010561A

United States Patent [19]

Dyson

[11] Patent Number: 6,010,561

[45] **Date of Patent: *Jan. 4, 2000**

[54] VACUUM CLEANER AND A FILTER ASSEMBLY THEREFOR

[75] Inventor: James Dyson, Little Somerford, United Kingdom

[73] Assignee: Notery Limited Kingsmead Mill, Little Somerford, United Kingdom

[ * ] Notice: This patent is subject to a terminal disclaimer.

[21] Appl. No.: 09/120,252

[22] Filed: Jul. 21, 1998

Related U.S. Application Data

[63] Continuation of application No. 08/836,498, May 7, 1997, abandoned.

[30] Foreign Application Priority Data

Nov. 19, 1994 [GB] United Kingdom ..... 9423756
Nov. 22, 1995 [WO] WIPO ..... PCT/GB95/02722

[51] Int. Cl.[7] ..... B03C 3/36

[52] U.S. Cl. ..... 96/63; 15/347; 55/471; 55/DIG. 3

[58] Field of Search ..... 55/337, 334, 471–473, 55/DIG. 2, DIG. 3; 15/347, 352; 96/61–63; 95/78

[56] References Cited

U.S. PATENT DOCUMENTS 3,871,847 3/1975 Fish ..... 55/DIG. 3
5,248,323 9/1993 Stevenson ..... 55/DIG. 3

FOREIGN PATENT DOCUMENTS 8420758 12/1985 Germany .
8500638 6/1986 Germany .
3526793 1/1987 Germany .
2167680 6/1986 United Kingdom .
2246717 2/1992 United Kingdom .
85/02100 5/1985 WIPO .

OTHER PUBLICATIONS

* References Cited in Parent Case SN 08/836,498.

*Primary Examiner*—Richard L. Chiesa
*Attorney, Agent, or Firm*—Ian C. McLeod; Mary M. Moyne

[57] ABSTRACT

The invention provides a filter assembly for use in a vacuum cleaner. The vacuum cleaner includes an airflow path (18), a dirt and dust collecting device arranged in the airflow path (18), a motor or fan unit (10) for causing air to flow along the airflow path (18). A first filter (12) is arranged immediately upstream of the motor or fan unit (10) and a second filter (14) is arranged downstream of the motor or fan unit (10), wherein the first and second filters (12, 14) are connected together so as to form the single filter assembly. The connection of the filters (12, 14) encourages the user of the vacuum cleaner to regularly maintain both filters (12, 14) thus improving the performance of the vacuum cleaner.

4 Claims, 1 Drawing Sheet

VACUUM CLEANER AND A FILTER ASSEMBLY THEREFOR

CROSS-REFERENCE TO RELATED APPLICATION

This application is a Continuation of U.S. application Ser. No. 08/836,498, filed May 7, 1997, now abandoned which claims priority to PCT/GB95/02722, filed Nov. 22, 1995, and U.K. Application No. 9423756.7, filed Nov. 24, 1994.

BACKGROUND OF THE INVENTION (1) Summary of the Invention

The invention relates to a vacuum cleaner and to a filter assembly therefor. It will be understood that the term "vacuum cleaner" is here used so as to encompass any type of cleaning apparatus which uses the creation of a vacuum to draw air along an airflow path.

(2) Description of Related Art

Vacuum cleaners of both the upright and cylinder types operate by utilizing a motor or fan unit to draw air along an airflow path from a dirty air inlet to a clean air outlet via some sort of filtering or dirt/dust separating apparatus. The air which passes along the airflow path thus passes through the motor or fan unit.

It is known to filter the air passing along the airflow path before it is expelled to the atmosphere. If the appropriate filter is located upstream of the motor or fan unit, any particles of dirt, carbon, etc. becoming entrained within the airflow inside the motor or fan unit will inevitably be expelled into the atmosphere with the airflow. If the filter is located downstream of the motor or fan unit, any dirt or dust remaining in the airflow after it has passed through the filtering or dirt/dust separating apparatus will pass through the motor or fan unit. This may cause the motor or fan unit to become unbalanced which will shorten its life and may result in premature failure. Also, dust can collect and build up in the region of the motor or fan unit which can result in sudden unwanted releases of large quantities of fine dust which can cause blockage of the filter or damage the motor or fan unit.

A very few manufacturers have, prior to the date of this application, been fitting electrostatic filters both before and after the motor or fan unit. This has the advantage of preventing dusty air from passing through the motor or fan unit and also of preventing any particles released within the motor or fan unit from escaping into the atmosphere. However, two problems have been identified in respect of this arrangement. Firstly, even if the operator remembers to change one of the filters, the second filter is rarely changed. Presumably this is because changing the first filter gives the operator sufficiently improved performance for the changing of the second filter to be thought unnecessary or else the second filter is forgotten. Secondly, the operator has difficulty in ascertaining that the filters require changing because they are not easily visible.

It is an object of the present invention to provide a vacuum cleaner having filters arranged both before and after the motor or fan unit which is easy and convenient to operate and to maintain.

DETAILED DESCRIPTION OF THE PREFERRED EMBODIMENTS

The present invention relates to a vacuum cleaner comprising an airflow path, dirt and dust collecting means arranged in the airflow path, a motor or fan unit for causing air to flow along the airflow path and also arranged therein, a first filter arranged immediately upstream of the motor or fan unit and a second filter arranged downstream of the motor or fan unit, wherein the first and second filters are connected together so as to form a single filter assembly.

The present invention also relates to a filter assembly for use in a vacuum cleaner according to any one of the preceding claims, comprising a first filter for location in an airflow path upstream of a motor or fan unit and a second filter for location in the airflow path downstream of the motor or fan unit, wherein the first and second filters are connected together to form a single filter assembly.

Figure 1:
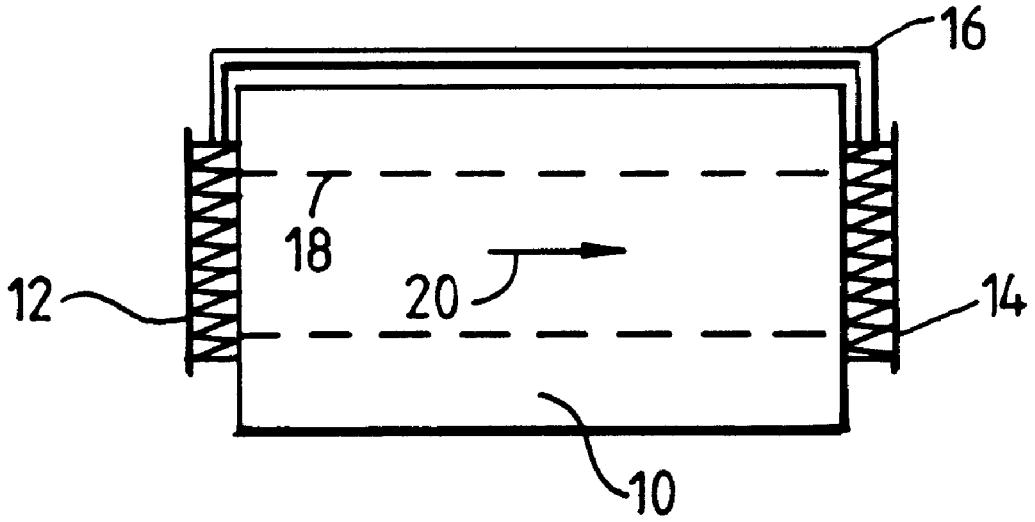
FIG. 1 is a schematic front view of the embodiment of the filters 12 and 14 connected by connecting member 16 on motor or fan unit 10.

An embodiment of the invention will now be described with reference to the accompanying drawings wherein:

FIGS. 1 an 2 each show schematic side views of a motor or fan unit forming part of a vacuum cleaner according to the present invention.

Figure 2:
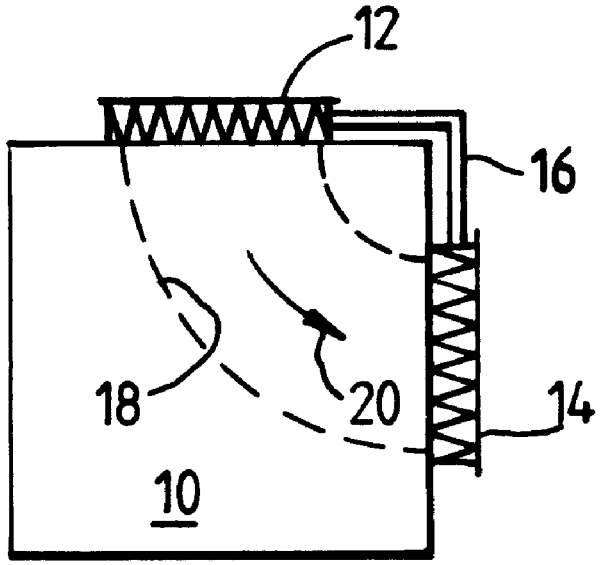
FIG. 2 is a schematic, front view of another embodiment of the filters 12 and 14 connected by connecting member 16.

Each of FIGS. 1 and 2 shows, in schematic side view, a motor or fan unit 10 having an airflow path 18 passing therethrough. The direction of airflow is shown by arrows 20. Each motor or fan unit is of conventional design and manufacture and will not be described further here.

Immediately upstream of the motor 10 and covering the entry of the airflow path 18 into the motor 10 is an electrostatic filter 12. A second electrostatic filter 14 is located immediately downstream of the motor 10 in the airflow path 18. A connecting member 16 extends between the filters 12, 14 thus forming a connection therebetween.

The electrostatic filters 12, 14 are of standard design and manufacture. However, it will be understood that alternative types of filter suitable for use in vacuum cleaners can be utilized. The connecting member 16 can be rigid or non-rigid and can be formed, if desired, from a single piece of material, e.g. a plastics material, or can be manufactured from a plurality of separate parts. A resilient or hinged construction is preferable for ease of packaging, storage and transportation. The connecting member 16 may be shaped to closely conform to the shape of the outer casing of the motor 10 or may be specifically designed to provide the user of the vacuum cleaner with a gripping portion or handle so as to facilitate the removal and replacement of the filters 12, 14.

The connection between the connecting member 16 and the filters 12, 14 may be permanent or temporary. For example, in the event that a suitable filter material is used for the filters 12, 14, the connecting member 16 can also be formed from the same material to produce an integral, one-piece filter assembly. Alternatively, the connecting member 16 may be formed integrally with the filter casings, filter material being inserted into each of the filter casings. In either case, when replacement of the filters 12, 14 is required, the entire filter assembly 12, 14, 16 is discarded and replaced by a new assembly. As a further alternative, the connecting member 16 can be of a more durable nature so that, if desired, the filters 12, 14 can be removed from the connecting element 16 and replaced with new filters before the filter assembly 12, 14, 16 is re-fitted into the vacuum cleaner.

If the connecting member 16 is formed from the same filter material as that used to form the filters 12, 14, the complete assembly may be shaped such that the portion of filter material forming the connecting member 16 is narrower than the portion forming the filters 12, 14. Equally, the connecting portion need not be shaped and the whole assembly may be generally rectangular in shape so as to merely "wrap around" the motor or fan unit 10 such that the inlet and outlet of the unit 10 are overlaid by filter material.

Although not shown in FIGS. 1 and 2, the motor 10 is located in a vacuum cleaner so that, when the dirt/dust collection means are removed for emptying or replacement, at least part of the filter assembly 12, 14, 16 is clearly visible by the user. Ideally, at least one of the filters 12, 14 is clearly visible in this situation. When the arrangement illustrated in FIG. 2 is utilized, it is possible and advantageous for the arrangement to be such that both filters 12, 14 are visible during emptying or replacement of the dirt/dust collection means. This is highly advantageous in that the user of the vacuum cleaner is reminded, each time the dirt/dust collecting apparatus is emptied or replaced, to check that the filters do not require replacement. Easy accessibility of the filters 12, 14 encourages the user of the vacuum cleaner to replace the filters 12, 14 as and when necessary. Also, the presence of a connecting member 16 between the filters 12, 14 means that, automatically, both filters 12, 14 are removed when a check is carried out. This avoids any possibility of the more accessible filter being properly maintained whilst the less accessible filter is neglected. If either of the filters 12, 14 becomes blocked, the effect on the performance of the vacuum cleaner will be adverse.

It will be appreciated by a reader skilled in the art that the invention is not restricted to the specific embodiment described above.

I claim:

1. A motor filter assembly consisting of a first filter connected to a second filter, wherein the filter assembly is provided in a vacuum cleaner comprising an airflow path, dirt and dust collecting means arranged in the airflow path, a motor or fan unit for causing air to flow along the airflow path and wherein the first filter is mounted adjacent to the motor or fan unit immediately upstream of the motor or fan unit for air inlet and the connected second filter is mounted adjacent to the motor or fan unit downstream of the motor or fan unit for air outlet wherein the first and second filters are separate and disconnected from the dirt and dust collecting means and the first and second filters are also simultaneously removable from the motor or fan unit.

2. The filter assembly of claim 1 wherein the filters are electrostatic.

3. The filter assembly of claim 1 wherein the filters are at right angles to each other when mounted adjacent to the motor or fan unit.

4. The filter assembly of claim 1 wherein the filters are electrostatic, and wherein the filters are at right angles to each other when mounted adjacent to the motor or fan unit.

* * * * *

UNITED STATES PATENT AND TRADEMARK OFFICE

CERTIFICATE OF CORRECTION

PATENT NO. : 6,010,561
DATED : January 4, 2000
INVENTOR(S) : James Dyson

It is certified that error appears in the above-identified patent and that said Letters Patent is hereby corrected as shown below:

Title page, [30], "Nov. 19, 1994 [GB] United Kingdom 9423756" should be --Nov. 24, 1994 [GB] United Kingdom 9423756.7--.

Column 2, line 21, "Figs. 1 an 2 each.show" should be --Figs. 1 and 2 each show--.

Signed and Sealed this

Sixth Day of February, 2001

*Attest:*

*Attesting Officer*

Q. TODD DICKINSON

*Director of Patents and Trademarks*